US007063506B2

(12) United States Patent
Davison et al.

(10) Patent No.: US 7,063,506 B2
(45) Date of Patent: Jun. 20, 2006

(54) TURBINE BLADE WITH IMPINGEMENT COOLING

(75) Inventors: Peter Davison, Wuensdorf (DE); Barbara Blume, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 145 days.

(21) Appl. No.: 10/887,219

(22) Filed: Jul. 9, 2004

(65) Prior Publication Data

US 2005/0111981 A1 May 26, 2005

(30) Foreign Application Priority Data

Jul. 11, 2003 (DE) ..... 103 32 563

(51) Int. Cl.
*F01D 5/18* (2006.01)

(52) U.S. Cl. ..... 416/97 R; 416/233

(58) Field of Classification Search ..... 416/95, 416/96 R, 97 R, 233
See application file for complete search history.

(56) References Cited

U.S. PATENT DOCUMENTS

| | | | |
|---|---|---|---|
| 5,403,158 A | 4/1995 | Auxier | |
| 5,660,524 A | 8/1997 | Lee et al. | |
| 5,674,050 A | 10/1997 | Hall et al. | |
| 6,036,441 A | 3/2000 | Manning et al. | |
| 6,206,638 B1 | 3/2001 | Glynn et al. | |
| 6,241,469 B1 | 6/2001 | Beeck et al. | |
| 6,644,920 B1 | 11/2003 | Beeck et al. | |
| 2003/0044277 A1 * | 3/2003 | Bourriaud et al. | 416/97 R |

FOREIGN PATENT DOCUMENTS

| | | |
|---|---|---|
| DE | 19848104 | 4/2000 |
| DE | 10059997 | 6/2002 |
| EP | 0659978 | 6/1995 |
| EP | 1001135 | 5/2000 |
| EP | 1022434 | 7/2000 |

OTHER PUBLICATIONS

European Search Report dated Aug. 9, 2004.
German Search Report dated Jul. 11, 2003.

* cited by examiner

*Primary Examiner*—Edward K. Look
*Assistant Examiner*—Richard A. Edgar
(74) *Attorney, Agent, or Firm*—Timothy J. Klima

(57) ABSTRACT

A hollow turbine blade cooled with compressor air is divided into a cooling air chamber (6) and into impingement air cooling chambers (8, 9) by inner, supporting partitions (3, 4). The cooling air is conveyed from the cooling air chamber into the impingement air cooling chamber via impingement air channels (7) provided in the partitions. The impingement air channels are concave with regard to the adjacent outer wall (2) of the blade airfoil (1) and arranged completely in the hot area near the outer wall and, in addition, have an oblong or elliptical cross-section whose longitudinal axis agrees with the radial orientation of the turbine blade. By reduced stress concentration in the area of the impingement air channels, the fatigue and creep characteristics are improved and life is increased.

8 Claims, 1 Drawing Sheet

TURBINE BLADE WITH IMPINGEMENT COOLING

This application claims priority to German Patent Application DE10332563.8, filed Jul. 11, 2003, the entirety of which is incorporated by reference herein.

BACKGROUND OF THE INVENTION

This invention relates to a turbine blade with impingement cooling of the thermally highly loaded outer wall sections, where at least one partition is provided in the interior of the hollow turbine blade to form a cooling-air chamber supplied with cooling air and where, with the formation of an impingement air cooling chamber, the partition is provided with a plurality of impingement air channels to apply cooling air to the remotely adjacent inner surface of the hot outer wall sections.

The efficiency of gas turbines can be improved by increasing the combustion chamber temperatures. Such temperature increase is, however, limited by the thermal loadability of the components exposed to the hot gases, in particular the stator vanes and rotor blades in the turbine stage downstream of the combustion chamber, which additionally are subject to high mechanical stresses. In order to prevent transgression of the material-specific temperature limits, the respective components and, in particular, their thermally highly loaded areas are, as is generally known, cooled with cooling air tapped from the compressor.

In the case of an impingement cooling for a turbine blade known from Specification EP 1 001 135 A2, for example, longitudinal partitions are arranged in the inner of a hollow blade confined by two side walls which, together with a side wall section, form a long cooling air supply and distribution chamber (cooling air chamber) and, adjacent to the cooling air chamber, several impingement air cooling chambers. Via the impingement air channels, the cooling air introduced into the cooling air chamber flows—consecutively or in other cases also simultaneously—into the adjacent impingement air cooling chambers, thereby intensely cooling the inner surfaces of the thermally highly loaded areas of the outer walls of the turbine blade from the inside and enabling the gas turbine to be operated with high efficiency at maximum combustion temperatures and without material damage. The impingement air channels are straight-lined, but inclined within the partition to ensure a favorable angle of impingement of the impingement cooling air onto the inner surfaces of the outer walls. In addition, the air exiting from the impingement air cooling chambers via air channels in the sidewalls of the turbine blade creates a barrier layer between the blade material and the hot gas which further reduces the thermal load of the turbine blade.

While the impingement air channels reduce the load-carrying area of the partitions supporting the outer walls, load peaks occur in the area of the impingement air channels which entail high local mechanical stresses and, in consequence, a reduction of the life of the turbine blade. Furthermore, appropriately large dimensioning of the thickness of the partitions, which would decrease the local load peaks, is to be ruled out for reasons of weight and associated loads.

BRIEF SUMMARY OF THE INVENTION

A broad aspect of the present invention is to provide a design of a turbine blade of the type described above which decreases the load peaks in the area of the impingement air channels, thus increasing the fatigue and the creep strength and, ultimately, the life of the turbine blade, with the weight of the turbine blade remaining essentially unchanged.

It is a particular object of the present invention to provide solution to the above problems by a turbine blade designed in accordance with the features described herein. Further features and objects of the present invention will become apparent from the description below.

The present invention realizes that the partitions are coolest in the center area and represent a zone of maximum tensile stress. In the turbine blades according to the state of the art, the stress concentrations are particularly high in this area, this being due to the fact that this area accommodates the entries of the impingement air channels which are straight-lined and inclined to obtain a specific angle of air impact. According to the present invention, the impingement air channels are now curved such that the position and the angle of impingement air exit remain unchanged and the impingement air is directed onto the inner surface of the respective outer wall section at a specific angle, while the air entry and, thus, the entire impingement air channel is re-located towards a hotter end area of the partition where lower tensile stresses apply. The impingement air channel is concave with regard to the outer wall and entirely extends near, and virtually parallel to, the hot outer wall. This form and arrangement of the impingement air channels reduces the notch effect and increases the creep and fatigue strength, thus improving the life of the turbine blade. Furthermore, the decrease in stress concentration so obtained permits smaller partition wall thicknesses in the area of the impingement air channels, thus enabling the weight of the turbine blade to be reduced.

In accordance with a further, significant feature of the present invention, the cross-sectional area of the impingement air channels has the shape of an oblong hole or an oval, with the longitudinal axis of the oval or oblong hole extending in the longitudinal direction of the cooling air chamber. This cross-sectional shape, its radial orientation and the resultant low notch factor also improve the creep and fatigue characteristics and, thus, increase the life of the turbine blade. Furthermore, the wall thickness of the partitions can be reduced, enabling the weight of the turbine blade to be decreased. It was found that, in particular, the combination effect between the impingement air channel curvature, which allows the impingement air channels to be fully routed in the hot area of the partitions, and the above mentioned cross-sectional shape and orientation yield an unexpected increase in creep and fatigue strength, resulting in a long service life of the turbine blade.

BRIEF DESCRIPTION OF THE DRAWINGS

The present invention is more fully described in the light of the accompanying drawings showing a preferred embodiment. In the drawings.

DETAILED DESCRIPTION OF THE INVENTION

Figure 1:
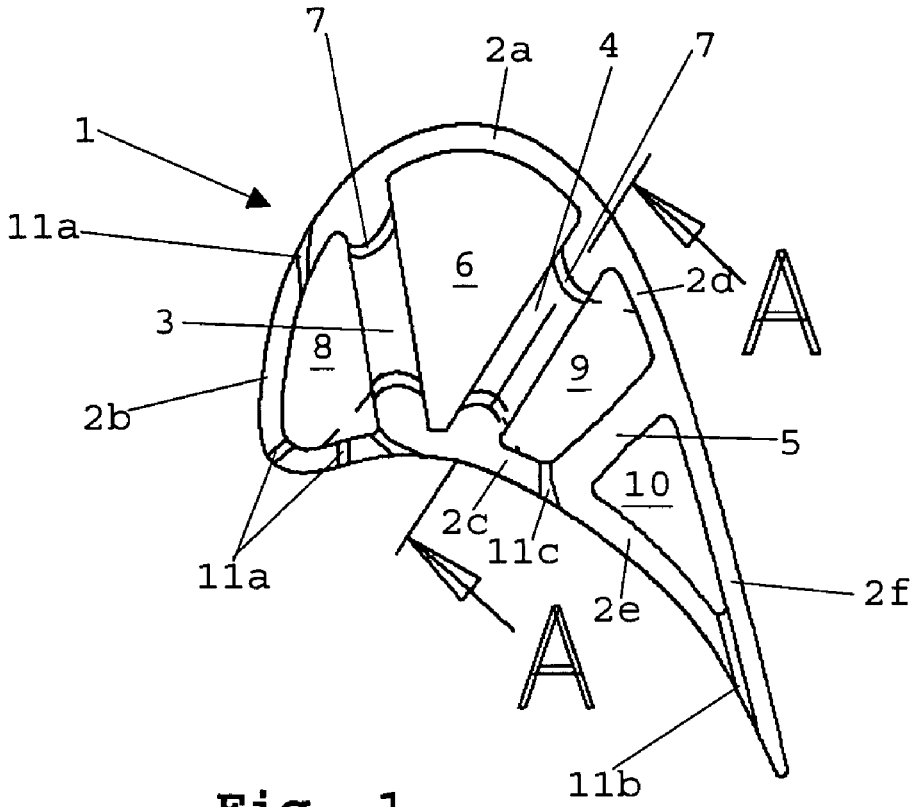
FIG. 1 is a sectional view of a turbine blade.

The airfoil 1 of a high-pressure turbine blade comprises a thin-walled outer wall 2 and supporting inner partitions 3 to 5. The first and second supporting partitions 3 and 4 together with an outer wall section 2*a* confine a cooling air chamber 6 into which cooling air tapped from the compressor of the gas turbine is continuously introduced. In the end area of the first and second partition 3 and 4, i.e. in the vicinity of the outer wall, impingement air channels 7 are arranged which are concave with regard to the outer wall, originate at the cooling air chamber 6 and issue into the first or the second impingement air cooling chamber 8 or 9, respectively. The impingement air cooling chamber 8 is confined by the first partition 3 and an outer wall section 2*b*, while the second impingement air cooling chamber 9 is formed by the second partition 4, two outer wall sections 2*c*, 2*d* and the third partition 5. The third partition 5 and two outer wall sections 2*e*, 2*f* enclose a further cooling chamber 10. The cooling air supplied to the cooling chamber 6 flows via the impingement air channels 7—which, owing to their curvature, extend fully in a hot, relatively lowly stressed area of the first and second partition 3 and 4 near the outer wall 2—into the first or second impingement air cooling chamber 8 or 9, respectively, in which the cooling air hits the inner surfaces of the adjacent outer wall sections 2*b*, 2*c* and 2*d*, thereby cooling these sections intensely. The cooling air introduced into the first impingement air-cooling chamber 8 flows via air channels 11*a* in the outer wall section 2*b* to the outer surface, providing this area with an air layer as external protection of the material against hot air. The cooling air in the second impingement air cooling chamber 9 flows via the cooling chamber 10 and the cooling channels 11*b*, or immediately via the cooling channels 11*c*, to the outside. The curvature of the impingement air channels 7, which enables the impingement air channels to be located into the end areas of the respective partitions 3 and 4 near the outer wall 2 without altering the exit direction of the cooling airflow leaving the impingement air channels 7 from that known of inclined impingement air channels, considerably reduces the stresses in the partitions 3 and 4 in the area of the impingement air channels 7. The orientation of the impingement air channels 7 is preferably set to align with adjacent portions of the outer wall 2, or, in other words, to be generally parallel with the adjacent portions of the outer wall 2.

Figure 2:
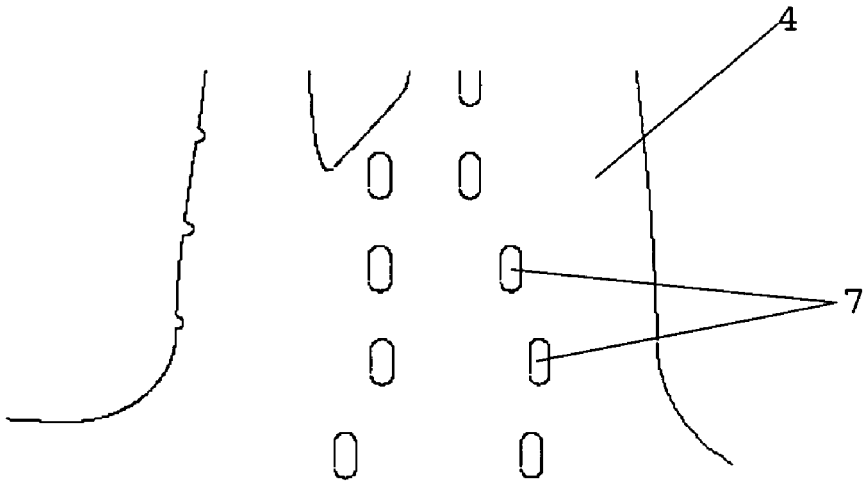
FIG. 2 is a cross-section along line 'AA' in FIG. 1.

Further reduction of the stress concentration in these areas is obtained by the cross-sectional area of the impingement air channels 7 having the shape of an oblong hole, as shown in FIG. 2, and the longitudinal axis of the cross-sectional area agreeing with the longitudinal axis of the blade airfoil 1 or its radial orientation. Likewise, the cross-sectional area of the impingement air channels can be elliptical. Owing to the elliptical or oblong shape of the impingement air channels in connection with the orientation of the longitudinal axis of the cross-sectional area relative to the dominant load vector, the fatigue strength is increased and the notch effect reduced, thus providing for a longer service life of the high-pressure turbine blade.

| | List of reference numerals |
|---|---|
| 1 | Blade airfoil |
| 2 | Outer wall |
| 2a–2f | Outer wall sections |
| 3 | First partition |
| 4 | Second partition |
| 5 | Third partition |
| 6 | Cooling air chamber |
| 7 | Impingement air channel |
| 8 | First impingement air cooling chamber |
| 9 | Second impingement air cooling chamber |
| 10 | Cooling chamber |
| 11a–11c | Cooling channels |

What is claimed is:

1. A turbine blade with impingement cooling of thermally highly loaded outer wall sections, comprising: a hollow interior, at least one partition positioned in the hollow interior to divide the hollow interior into a cooling air chamber for supply of cooling air and an impingement air cooling chamber, the partition including a plurality of impingement air channels to supply impingement cooling air from the cooling air chamber to remotely adjacent inner surfaces of the hot outer wall sections positioned in the impingement air cooling chamber, the impingement air channels being concave in relation to and arranged essentially parallel with the adjacent outer wall and positioned in a hot area near the outer wall.

2. A turbine blade in accordance with claim 1, wherein the impingement air channels have one of an oblong or elliptical cross-sectional area, whose longitudinal axes are aligned with a radial axis of the blade.

3. A turbine blade in accordance with claim 2, comprising a further partition for dividing a second impingement air cooling chamber from the cooling air chamber, the further partition including a plurality of impingement air channels to supply impingement cooling air from the cooling air chamber to remotely adjacent inner surfaces of the hot outer wall sections positioned in the second impingement air cooling chamber, the impingement air channels being concave in relation to and arranged essentially parallel with the adjacent outer wall and positioned in a hot area near the outer wall.

4. A turbine blade in accordance with claim 1, comprising a further partition for dividing a second impingement air cooling chamber from the cooling air chamber, the further partition including a plurality of impingement air channels to supply impingement cooling air from the cooling air chamber to remotely adjacent inner surfaces of the hot outer wall sections positioned in the second impingement air cooling chamber, the impingement air channels being concave in relation to and arranged essentially parallel with the adjacent outer wall and positioned in a hot area near the outer wall.

5. A turbine blade comprising:

an outer wall, a hollow interior, at least one partition positioned in the hollow interior to divide the hollow interior into a cooling air chamber for supply of cooling air and an impingement air cooling chamber, a plurality of impingement air channels positioned in a hot area of the partition near the outer wall to supply impingement cooling air from the cooling air chamber to remotely adjacent inner surfaces of the outer wall positioned in the impingement air cooling chamber, the impingement air channels being curved with concave sides of the impingement air channels facing adjacent portions of the outer wall, the impingement air channels also being oriented essentially parallel with the adjacent portions of the outer wall.

6. A turbine blade in accordance with claim 5, wherein the impingement air channels have one of an oblong or elliptical cross-sectional area, whose longitudinal axes are aligned with a radial axis of the blade.

7. A turbine blade in accordance with claim 6, comprising:

a further partition positioned in the hollow interior for dividing a second impingement air cooling chamber from the cooling air chamber, a plurality of impingement air channels positioned in a hot area of the further partition near the outer wall to supply impingement cooling air from the cooling air chamber to remotely adjacent inner surfaces of the outer wall positioned in the second impingement air cooling chamber, the impingement air channels being curved with concave sides of the impingement air channels facing adjacent portions of the outer wall, the impingement air channels also being oriented essentially parallel with the adjacent portions of the outer wall.

8. A turbine blade in accordance with claim 5, comprising:

a further partition positioned in the hollow interior for dividing a second impingement air cooling chamber from the cooling air chamber, a plurality of impingement air channels positioned in a hot area of the further partition near the outer wall to supply impingement cooling air from the cooling air chamber to remotely adjacent inner surfaces of the outer wall positioned in the second impingement air cooling chamber, the impingement air channels being curved with concave sides of the impingement air channels facing adjacent portions of the outer wall, the impingement air channels also being oriented essentially parallel with the adjacent portions of the outer wall.

* * * * *